US005135272A

United States Patent [19]

Centofante

[11] Patent Number: 5,135,272

[45] Date of Patent: Aug. 4, 1992

[54] TRAVELER'S SECURITY BOLT

[76] Inventor: Alfred V. Centofante, 55 Whittington Course, St. Charles, Ill. 60174

[21] Appl. No.: 742,396

[22] Filed: Aug. 8, 1991

[51] Int. Cl.[5] ..... E05C 19/18

[52] U.S. Cl. ..... 292/293

[58] Field of Search ..... 292/290, 293, 294, 256.73, 292/256.75, 292

[56] References Cited

U.S. PATENT DOCUMENTS

| | | | |
|---|---|---|---|
| 540,423 | 6/1895 | Chivill | 292/293 |
| 684,000 | 10/1901 | Shore | 292/293 |
| 743,978 | 11/1903 | Fleischmann | 292/293 |
| 1,255,996 | 2/1918 | Ehrhardt | 292/293 |
| 1,293,414 | 2/1919 | Grimeck | 292/290 |
| 2,533,674 | 12/1950 | Locke | 292/256.75 X |
| 2,752,187 | 6/1956 | Gordon | 292/256.75 |
| 3,416,333 | 2/1967 | Weingart | 70/14 |
| 3,429,151 | 6/1967 | Weingart | 70/14 |
| 4,004,833 | 10/1975 | Hull | 292/288 |
| 4,285,535 | 8/1981 | Leary | 292/293 |
| 4,290,635 | 9/1981 | McKenzie | 292/290 |
| 4,605,251 | 7/1984 | Finlay | 292/288 |
| 4,627,651 | 3/1986 | Grimbly | 292/288 |
| 4,878,701 | 4/1987 | Rondel et al. | 292/288 |

*Primary Examiner*—Richard E. Moore

*Attorney, Agent, or Firm*—Allegretti & Witcoff, Ltd.

[57] ABSTRACT

A traveler's security bolt for securing the door to a room or building against unauthorized entry. The security bolt engages the strike plate of a door frame and operatively abuts the door and its associated frame from the interior of the room to prevent entry. The security bolt is constructed to fit a variety of doors and frames, including frames which have decorative moldings or trim, and to protect the door and frame against damage when force is exerted against the secured door.

1 Claim, 1 Drawing Sheet

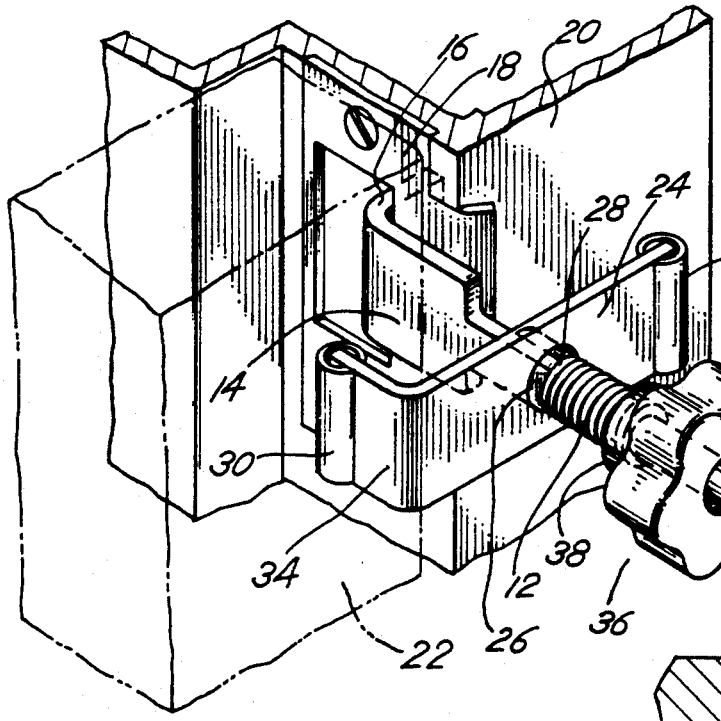
Fig. 1
Fig. 2
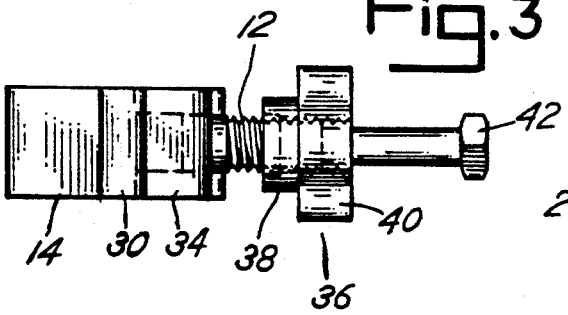
Fig. 3
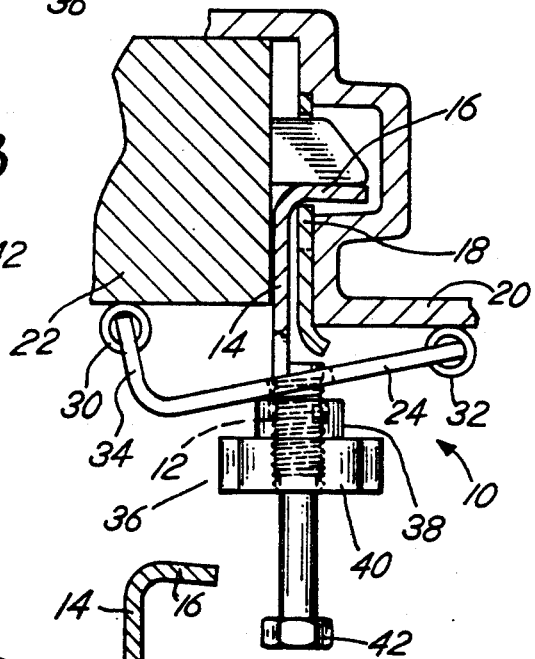
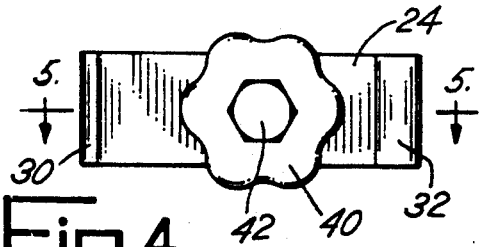
Fig. 4
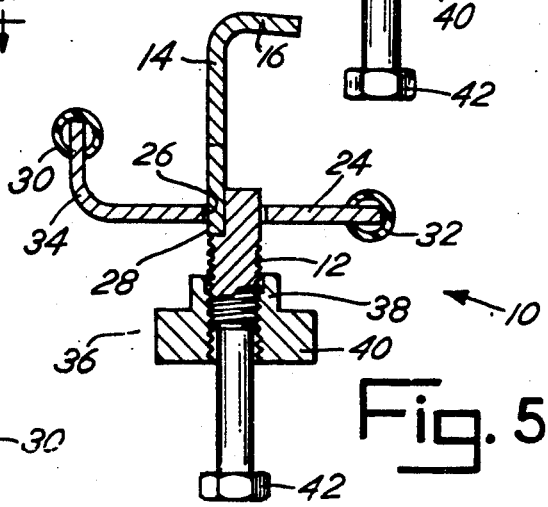
Fig. 5
Fig. 6
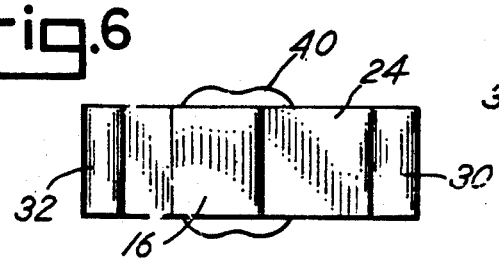

TRAVELER'S SECURITY BOLT

BACKGROUND OF THE INVENTION

This invention relates to a portable door securing device. More specifically, this invention relates to a traveler's security bolt which may be temporarily installed in the door frame of an inwardly swinging door in order to prevent unauthorized entry into a room or a building. The security bolt of the present invention is particularly adapted for travelers as it can be quickly and easily installed in a wide variety of doors having frames of differing size and shape without the use of extra tools. Also, it can be just as easily removed from the door in the event of an emergency or other circumstance which requires an expedited exit from a room. It is ideal for travel because it can be easily stored in a suitcase, purse or even a pocket, and is thus easy to transport. The security bolt operates by engaging the strike plate of a door frame at one end, and having an abutment plate tightened to contact the door and the frame in the interior of the room to be secured at the other end.

The need for portable door locks which can be quickly and easily installed and removed by occupants of a building or room for securing the entrance has long been recognized. Such locks are, for example, advantageous as supplemental locks in hotel rooms or restrooms, since the occupants of these premises have no control over the access to keys. Further, although various auxiliary locks are sometimes provided, they do not necessarily provide the desired degree of protection, and are also not always maintained in proper workable order.

PRIOR ART

The prior art discloses portable door locks which may be installed to prevent unauthorized entry into rooms or buildings. However, none of the prior art known to the applicant suggests the combination of advantageous features of the current invention.

U.S. Pat. No. 4,878,701, Rondel et al. (1989), relates to a portable door lock with a serrated tightening means and a handle for locking the lock in place. This patent discloses a fixed pressure block which is locked in place against the door and frame when the handle is moved in the locked position.

U.S. Pat. No. 4,627,651, Grimbly (1986), relates to a safety locking device for doors. This patent teaches the use of a supplemental door lock which requires the removal of both the strike plate of the door frame and the face plate of the door, and the attachment of new plates for installation of the lock.

U.S. Pat. No. 4,605,251, Finlay (1986), discloses a door lock. Finlay requires the use of tools, and the replacement of a portion of the existing door frame for installation of the lock.

U.S. Pat. No. 4,285,535, Leary (1981), discloses a portable auxiliary door lock. This patent discloses a device for abutting the door and not the frame, and securing the door through engagement with the strike plate of the door frame.

U.S. Pat. No. 4,004,833, Hull (1977), discloses a door lock device. The Hull device requires the replacement of the strike plate of the door frame, and utilizes a pad lock as the locking means.

U.S. Pat. No. 3,429,151, Weingart (1969), discloses a portable lock. Weingart includes a threaded member which engages the strike plate, and which is at a right angle to the abutment plate which is used for securing the door.

U.S. Pat. No. 3,416,533, Weingart (1968), discloses a travel lock. The patented device includes a threaded member which engages the strike plate, and which is at a right angle to the abutment plate which is used for securing the door. Furthermore, this invention uses an additional locking means such as a pad lock to keep the lock in place.

A variety of supplemental locks which can be stored and carried have been disclosed in the prior art. Many of these prior art devices require the use of pad locks, or the use of tools to install them. These devices are not suitable for the traveler who is looking for an easy to install portable lock. None of the prior art known to the applicant suggests the advantageous construction of a traveler's security bolt which is anchored by both the door and the door frame thus preventing unnecessary damage, and which allows for use of the security bolt with door frames of various shapes, sizes, moldings, and decorative trims.

SUMMARY OF THE INVENTION

In accordance with the present invention, a portable traveler's security bolt is disclosed. An object of this invention to provide a portable traveler's security bolt which can be easily attached to a door to prevent unauthorized entry into a room or a building.

Another object of this invention to provide a portable traveler's security bolt which can be removed quickly and easily from a door to allow exit from a room in case of an emergency.

Yet another object of this invention to provide a portable traveler's security bolt which is relatively simple to use and economical to construct.

A further object of the present invention to provide a traveler's security bolt which has the flexibility to be utilized with door frames having molding or trim of varying shapes and sizes.

Another object of the present invention to provide a traveler's security bolt which is sturdy, and which provides stability in its locking means.

A further object of the present invention to provide a traveler's security bolt which can spread any force exerted against the lock over a large area to aid in preventing damage to the door or its frame.

Other objects and advantages of the present invention will be made apparent hereinafter.

The traveler's security bolt or the present invention provides a means by which temporary occupants of a room or building may increase the security of their surroundings. The bolt provides a device which may be installed in seconds without the use of tools or auxiliary devices, and may be carried easily in a purse or pocket. The security bolt may also be removed quickly and easily without the need of tools or keys which may hinder escape in any type of emergency.

The traveler's security bolt of the present invention is comprised of a threaded rod extending axially into a thin, flat plate member which is formed into a transversely extending hook-like portion for engagement with the strike plate of a door frame. In use, the hook-like portion of the threaded rod engages the strike plate and is positioned to pass between the door and the adjacent frame and extend inwardly into the area to be secured. The door is clamped shut by an abutment plate.

The abutment plate is generally "L" shaped, with an elongated main section and an offset flange. The elongated main section defines an opening through which the threaded rod may pass. The inside diameter of the opening is larger than the outside diameter of the threaded rod to allow the abutment plate to pivot with respect to the threaded rod. When the abutment plate is tightened over the door and associated frame, the end of the flange portion of the abutment plate contacts the door and the end of the flat portion contacts the door frame. Thus, the abutment plate acts as a clamp with respect to the hook-like portion of the threaded rod and holds the door closed. The security bolt may be removed by simply loosening the tightening means, turning the abutment plate, and opening the door.

Because every door is different, and there is no telling what particular door the security bolt will be used in conjunction with, it is necessary to construct the security bolt in a manner so as to allow its use with a variety of doors and frames. The current invention provides this flexibility which stems from (1) the pivotal connection between the abutment plate and the threaded rod, and (2) the fact that the abutment plate is generally "L" shaped. These features allow the abutment plate to contact and clamp door frames which are not flush with the door, and which extend inwardly beyond the plane of the door. Further, since the abutment plate contacts both the frame and the door, its spreads any force which may be exerted against the bolt over a large area, thus lessening the possibility of damage to the door or frame.

BRIEF DESCRIPTION OF THE DRAWINGS

There is shown in the drawings a presently preferred embodiment of the present invention wherein like numerals refer to like elements in the various views, and wherein:

FIG. 1 is a perspective view of the traveler's security bolt of the present invention showing its use in conjunction with a door and its associated frame, before tightening;

FIG. 2 is a view from the top of the traveler's security bolt of the present invention showing its use in conjunction with a door and its associated frame, which are shown in cross-section;

FIG. 3 is a side view of the traveler's security bolt;

FIG. 4 is an end view of the traveler's security bolt;

FIG. 5 is a cross-sectional view of the traveler's security bolt shown along line 5—5; and FIG. 6 is an end view of the traveler's security bolt, showing the opposite end depicted in FIG. 4.

DETAILED DESCRIPTION OF THE PRESENT INVENTION

With reference now to FIGS. 1–6, the present invention relates to a traveler's security bolt of the type generally indicated at 10. The security bolt 10 includes a threaded rod 12 which is formed into or joined with a relatively thin, flat plate 14 at one end. As illustrated in FIGS. 1 and 2 the plate 14 includes a transversely extending hook-like portion 16, which is formed to extend into the opening in the strike plate 18 and to operatively engage the strike plate 18 of a door frame 20. The thin plate 14 is relatively thin so that the door 22 may be closed while the plate 14 is inserted between the door 22 and its associated frame 20. Both the threaded rod 12 and plate 14 are preferably composed of a metal which is capable of withstanding axially directed tensional forces.

When the door 22 is closed, the threaded rod 12 extends inwardly into the area to be secured. An abutment plate 24 is pivotally connected to the threaded rod 12. This pivotal connection is preferably accomplished by forming the abutment plate 24 with an opening 26 which is of a greater diameter then the outside diameter 28 of the threaded rod 12 to allow for pivoting. This possibility of pivoting allows the abutment plate 24 to contact both the door 22 and the door frame 20 regardless of whether the two are laying flush in the same plane or not. The abutment plate 24 is equipped with protective covers 30 and 32, which protect the door 22 and the frame 20 when the abutment plate 24 is clamped down in its locking position. These protective covers 30 and 32 are preferably formed of a soft plastic, foam, or other suitable non-abrasive material. The abutment plate 24 is generally "L" shaped, with an elongated main section receiving the threaded rod 12 and an offset flange 34 at one end. This flange 34 keeps the abutment plate 24 in contact with both the door 22 and frame 20 after tightening in order to provide for a distributed load of any force exerted against the security bolt, thus protecting the door 22 and frame 20 from damage.

The traveler's security bolt 10 is also equipped with a tightening mechanism 36. The tightening mechanism 36, in preferred embodiment, is composed of a tightening nut 38 which operatively engages the threaded rod 12 and a handle 40. The handle 40 may be any shape, but is preferably equipped with alternating projections and recesses to allow for easy tightening of the nut 38 by hand. The handle 40 is constructed to encompass the nut 38 so that for every turn of the handle 40 a corresponding turn of the nut 38 results. In another embodiment the entire tightening mechanism 36 may be comprised of a single wing nut. When the tightening mechanism 36 is tightened along the threaded rod 12 the tightening mechanism 36 comes into contact with the abutment plate 24 to force the ends thereof into contact with the door 22 and frame 20, respectively. The flange 34 of the abutment plate 24 should be associated with the door 22, while the end of the main section of the abutment plate should come to rest in association with the frame 20.

In the preferred embodiment the threaded rod 12 is capped off at its end by an end cap 42. This end cap may either be attached to the threaded rod 12 or may extend from the threaded rod 12. In either event, the end cap 42 operates to allow the traveler's security bolt 10 to be maintained as a single integral unit. In another embodiment, the end cap 42 is unnecessary and the traveler's security bolt may come apart and be carried as two separate pieces, namely, the threaded rod 12 with the flat plate 14 and the abutment plate 24.

I claim:

1. A traveler's security bolt for securing a door in its frame comprising an engaging means adapted to be connected in the frame, and an abutment plate operatively connected to the engaging means and abutting the door and the frame for securing the door relative to the frame; said engaging means comprising a planar substantially blunt and relatively thin, hook-like portion for substantial engagement with a strike plate in the frame, and an elongated rod portion having a circular cross-section and having an exterior that is at least partially threaded; said abutment plate being substantially planar and elongated and adapted to engage both the door and the frame, said abutment plate having an opening therein receiving the rod portion of the engaging means, said opening having an inside diameter which is larger than the outside diameter of the rod portion to allow the abutment plate to pivot with respect to the engaging means, the abutment plate further defining a frame end for engaging the frame and a door end for engaging the door, wherein the door end defines a flange which extends outside the plane of the abutment plate and contacts the door; a tightening means for threaded engagement with the rod portion of the engaging means, said tightening means comprising a nut which is equipped with a handle for turning and tightening the nut, the tightening means adapted to contact the abutment plate; and an end cap which is connected to the elongated rod portion of the engaging means, whereby when the hooklike portion of the engaging means engages the strike plate of the frame and the enclosed door is subsequently closed, the tightening means moves the abutment plate against both the door and the frame for securing the door and whereby the end cap keeps the tightening means, abutment means and engaging means integrally connected as a single unit at all times, wherein the door end and the frame end of the abutment plate are each fitted with a protective cover, each cover comprising a split tubular element secured over each said end of said abutment plate.

* * * * *